US005869106A

United States Patent [19]

Rosaldo

[11] Patent Number: 5,869,106

[45] **Date of Patent: *Feb. 9, 1999**

[54] APPARATUS FOR MAKING TWO-COMPONENT FIBERS

[76] Inventor: Fare'Rosaldo, Via Papa Giovanni XXIII, 20, Fagnano Olona, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 654,351

[22] Filed: May 28, 1996

[30] Foreign Application Priority Data

Jan. 23, 1996 [IT] Italy ..... MI96A0110

[51] Int. Cl.[6] ..... B29C 47/10; B29C 47/00

[52] U.S. Cl. ..... 425/131.5; 425/463; 425/DIG. 217

[58] Field of Search ..... 425/131.5, 463, 425/DIG. 217, 467; 264/176.1

[56] References Cited

U.S. PATENT DOCUMENTS

| | | | |
|---|---|---|---|
| 3,182,352 | 5/1965 | Baer | 425/131.5 |
| 3,344,472 | 10/1967 | Kitajima et al. | 425/131.5 |
| 3,487,142 | 12/1969 | Johnson et al. | 425/131.5 |
| 3,559,237 | 2/1971 | Van Den Biggelaar et al. | 425/131.5 |
| 3,716,614 | 2/1973 | Okamoto et al. | 425/131.5 |
| 4,445,833 | 5/1984 | Moriki et al. | 425/131.5 |
| 5,227,109 | 7/1993 | Allen, III et al. | 425/131.5 |
| 5,344,297 | 9/1994 | Hills | 425/131.5 |
| 5,466,142 | 11/1995 | Miani | 425/131.5 |

FOREIGN PATENT DOCUMENTS

| | | | |
|---|---|---|---|
| 48-28361 | 8/1973 | Japan | 425/131.5 |

*Primary Examiner*—Jay H. Woo
*Assistant Examiner*—Robert Hopkins
*Attorney, Agent, or Firm*—Kennedy, Covington, Lobdell & Hickman, LLP

[57] ABSTRACT

In an apparatus for making two-component fibers, a polymer which is supplied laterally with respect to a further polymer and a die, is at first distributed inside cross-channels provided in a pre-die, and then being redirected, through holes in the extruding direction. The channels operate to rearrange the polymeric mass with the new distribution above the die, so as to eliminate possible discontinuities of the values of the chemical-physical parameters of this mass and which are due to the direction variation the mass is subjected to as it is switched from the side channels to the cross channels. Thus, a constant value of the mentioned parameters through the polymer mass being supplied to the extruder is assured.

13 Claims, 5 Drawing Sheets

APPARATUS FOR MAKING TWO-COMPONENT FIBERS

FIELD OF THE INVENTION

The present invention relates to a method and apparatus for making two-component fibers.

BACKGROUND OF THE PRIOR ART

It is known that, synthetic fibers are conventionally made by extruding through a die a molten polymeric mass. This die essentially comprises a plate provided with a plurality of very small holes, at the outlets of which a corresponding number of very thin fibers are formed. By this apparatus it is possible to also make the so-called "two-component fibers", that is yarns formed from a combination of two different polymers. In this case, the molten polymeric masses are separately supplied to the extruding die, at the outlet of which are obtained composite fibers made of the two polymers (for example the so-called "side-by-side" or "sheath-core" fibers).

A critical aspect of these prior methods for making the above mentioned fibers, is constituted by the molten polymeric mass supply to the extruding die. In fact, the viscosity of the materials to be extruded, together with the very complex configuration and very small size of the channels provided for distributing the mentioned materials, will involve modifications of the design parameters related to the supply of the molten polymeric masses to the extruding die. In particular, great differences are encountered through the polymeric mass supplied to the die, with respect to the pressure, rate, temperature and viscosity values of said mass, which differences will cause in turn unevenesses in the supply of the polymers to the extruding apparatus. Because of the mentioned reasons, the amounts of extruded materials are not constant and the yarn material exiting the die has a randomly carrying count (the diameters of the fibers being very different). In particular, in making two-component fibers, the yarn is conventionally richer in the polymeric material of lower density and having a lower viscosity, and, generally, the obtained fiber includes therein the two polymers in a randomly varying ratio.

SUMMARY OF THE INVENTION

Thus, it should be apparent that in the two component fiber making field exists the need of providing an extruding apparatus suitable to provide fibers of constant count, in particular a count as near as possible to the designed count. Moreover, the need exists of assuring an even and constant distribution of the two polymers in the two-component yarn.

The aim of the present invention is just that of providing a method for making two component fibers which allows to easily make a constant or even count two component fiber having a very even and constant composition.

Within the scope of the above mentioned aim, a main object of the present invention is to provide a method in which the supply of the polymeric materials to the extruding die can be accurately controlled so as to send to the extruding die even set amounts of polymeric material with a set distribution (for example of the "side-by-side" and "sheath-core" type).

Yet another object of the present invention is to provide an apparatus for making two-component fibers of constant count and with an even distribution of the polymeric materials constituting the fiber or yarn.

According to one aspect of the present invention, the above mentioned aim and objects, as well as yet other objects, which will become more apparent hereinafter, are achieved by a method and apparatus for making two component fibers, said method comprising the steps of simultaneously extruding molten masses of a first component (A) and a second component (B), at least one (B) of which is supplied in a direction different from the extruding direction, and being characterized in that said method provides, upstream of said extruding die, a stage in which said at least a component (B) is collected and made homogeneous, so as to provide even chemical-physical parameters of the composite polymeric mass to be sent to the extruder.

According to a further feature of the method according to the present invention, said method provides moreover, downstream of said stage performed on the component (B), a further step of supplying said component (B) held separated from the first component (A), in the extruding direction and, then, said components being supplied, in a combined form, to the extruding step.

The apparatus according to the present invention, for performing the above disclosed method is, of the type comprising a distributing system for distributing molten masses of a first component (A) and a second component (B) and a die provided with a plurality of extruding holes for extruding said components, in which at least one component B is supplied in a direction different from that of said holes of said die and, is substantially characterized in that said apparatus comprises, moreover, means for adjusting the values of said physical parameters of the full mass of said at least component (B) to be supplied to the extruder.

According to a further feature of the apparatus of the present invention, the mentioned means comprise a pre-die having a plurality of channels, arranged on the top of said die, in which said at least component (B) is collected and homogenized in its chemical-physical parameters.

With respect to conventional prior apparatus and methods, the present invention provides the advantages of precisely controlling, point by point, the parameters (pressure, temperature, rate or speed, viscosity) affecting the supplying of molten polymeric masses to the extruding die. In fact, the polymeric mass supplied laterally to the die, and which is provided for spreading to the surface of the die, has very even temperature, pressure, values, as well as very even values of the other parameters of the polymeric mass. The mentioned discontinuities, which increase as the distance of the polymeric mass to its side supplying region is increased, are overcome or eliminated during the claimed collection and adjusting step which is performed on the polymeric mass being laterally supplied, before sending it to the extruder. Moreover, owing to the herein claimed polymeric mass distributing system, including the above mentioned channels for distributing the components to be extruded, it is possible to precisely locally control the supply of the polymeric materials to the extruding die. The made fiber, accordingly, will be constituted by the set composition of the set amounts of the two polymeric materials, thereby assuring an even count of the yarn, as well as a very homogeneous composition thereof and a precise holding of its configuration or shape, for all of the fibers which are extruded.

BRIEF DESCRIPTION OF THE DRAWINGS

The above mentioned and other features and advantages of the present invention will become more apparent from the following detailed disclosure of a preferred, through not exclusive, embodiment of the inventive apparatus which is illustrated, by way of an indicative but not limitative example, in the figures of the accompanying drawings, where.

DESCRIPTION OF THE PREFERRED EMBODIMENT

Figure 1:
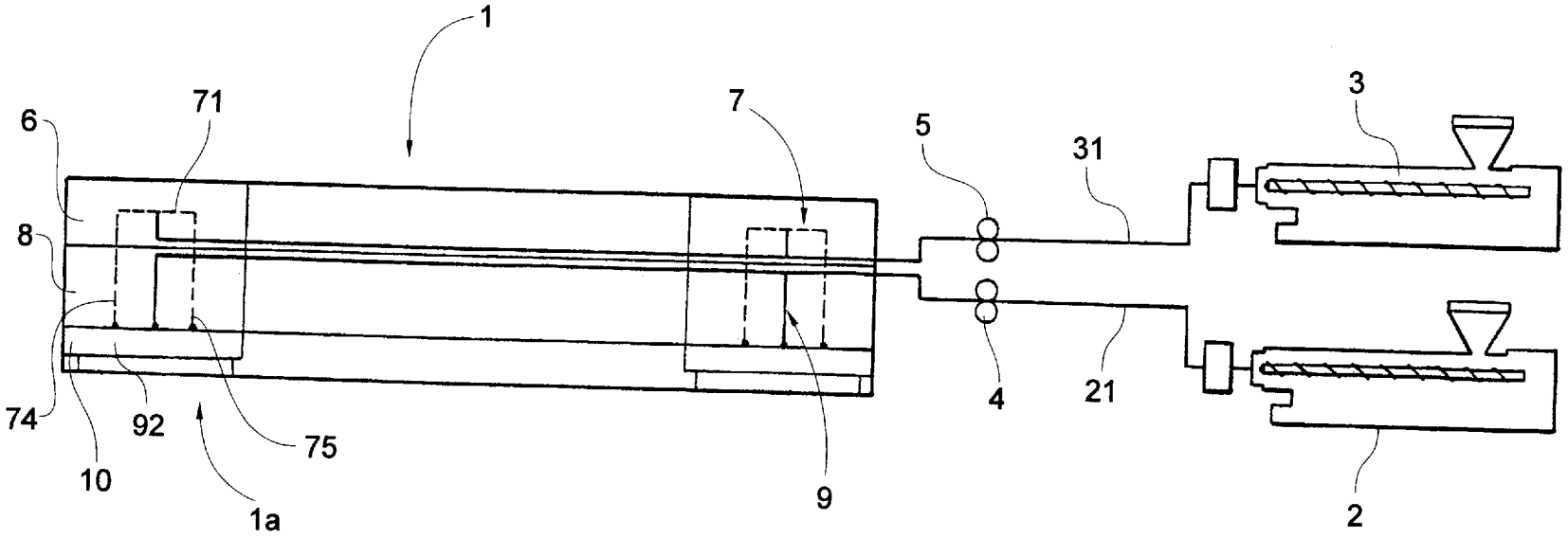
FIG. 1 is a schematic view illustrating an exemplary embodiment of a system for making two-component fibers, including the extruding apparatus according to the present invention.

The system for making two-component fibers illustrated in FIG. 1 comprises an extruding apparatus, indicated generally by the reference number 1, which is supplied with separated masses or streams of molten polymers A and B, through extruders 2 and 3 and gear pumps 4, 5.

The apparatus 1 essentially comprises a distributing pack 6 and 8, with which an extruding die 10 is associated (see the detail 1A of FIG. 1). This distributing pack comprises:

- a top plate 6, of ring configuration, through which is provided a first length 71 of the distributing channel 7 for distributing the polymer B (dashed line of FIG. 1), and
- a bottom plate 8, having a shape like that of the plate 6, and which provides the distributing channel 9 for distributing the polymer A (solid line of FIG. 1), as well as the second distributing channel length 74, 75 for distributing the polymer B (see the dashed lines of the detail 1A of FIG. 1).

Figure 2:
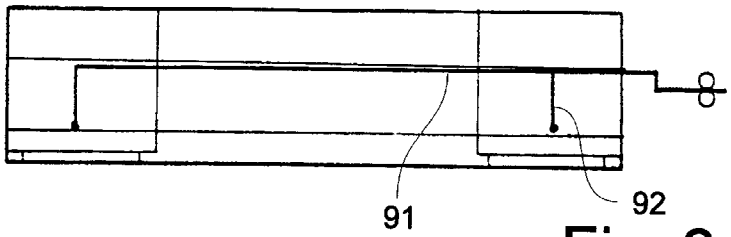
FIGS. 2 and 3 are respectively a side elevation view and a top plan view illustrating the channel arrangement for distributing the polymer A.
Figure 3:
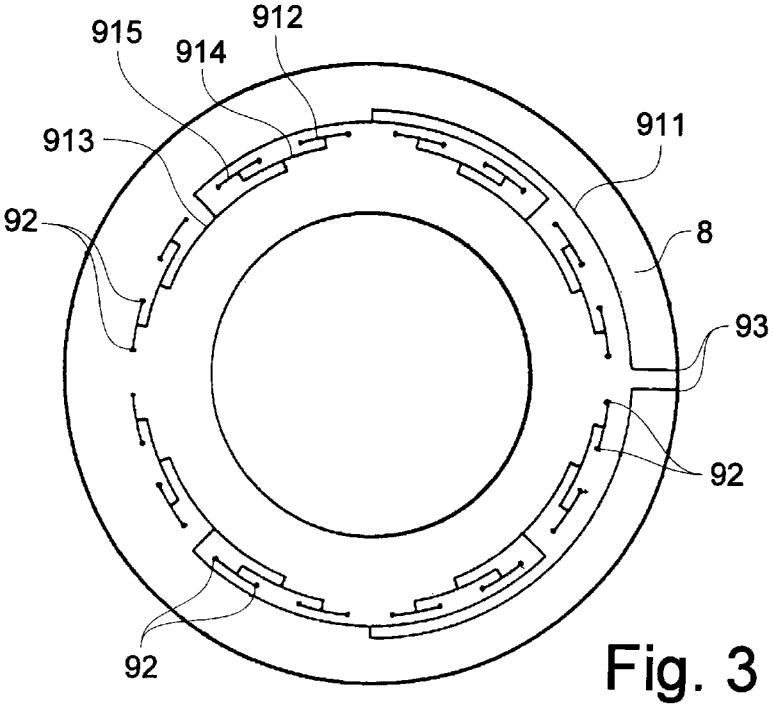

As is clearly shown in FIGS. 2 and 3, the distributing channel 9 for distributing the polymer A comprises a plurality of circle arch paths 91, arranged on the plane of the annular construction of the plate 8. This duct comprises inlets 93, provided on the same plate 8, and ending with a plurality of outlet channels 92, which are arranged perpendicularly to the laying plane of the mentioned circle arches 91.

The path followed by the polymeric mass inside the channel 9 is such that the spacing between the inlets 93 and the outlet channels 92 is always held constant, independently from the arrangement of the outlet channels inside the plate 8 (see FIG. 3). Thus, the time spent by the polymeric mass from the inlets 93 to the channels 92 will be always the same, independently from the arrangement of the mentioned outlet channels 92 through the plate 8.

For this purpose, the above mentioned channel 9 comprises a plurality of channel segments (of circle arch shape in the embodiment being illustrated) which are mutually linked with a symmetrical type of arrangement in which, at each half-circular portion of the annular plate 8 it is possible to distinguish:

- a first circle arch path 911, of an extension corresponding to 90°, provided for receiving the polymer A from the inlet 93 and for supplying said polymer at the level of the central or middle point of
- a second circle arch 912, also having an extension corresponding to 90°, the opposite end portions of which supply the polymer A to the central or middle point of respective circle arches 913.

With a like arrangement, from the ends of the mentioned paths 913, like circle arch paths 914 and 915 extend, on some of which are arranged the mentioned outlet channels 92. Advantageously, in order to hold the mentioned outlet channels at a central position, or at an innermost position of the annular surface of the plate 8, the end channels 914 and 915 are included between the line of the preceding channels 912 and 913.

Figure 4:
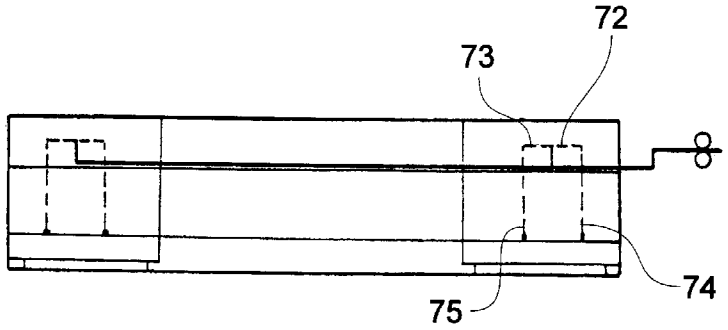
FIGS. 4 and 5 are respectively a further side elevation view and a top plan view illustrating the channel arrangement for distributing the polymer B.
Figure 5:
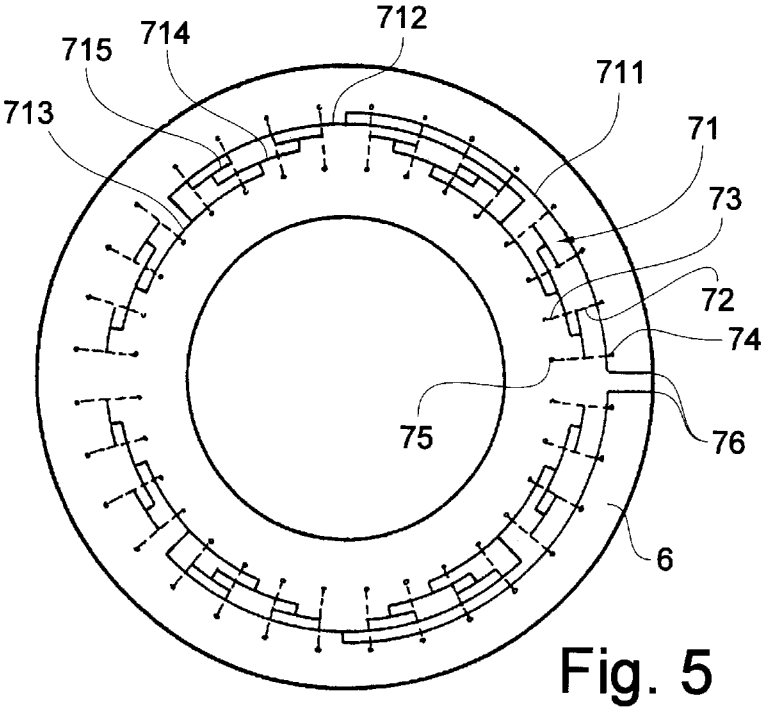

The distributing channel 7 for distributing the polymer B, as stated, is provided with a first channel portion 71, arranged on the plate 6, which extends with two horizontal arms 72 and 73, radially oriented with respect to the annular or ring-like construction of the same plate 6 (FIG. 5). Each arm 72, 73 ends in turn with a respective channel 74 and 75 which is arranged perpendicularly to the arms 72, 73 and passes through the overall thicknesses of the plates 6 and 8 (see FIGS. 4 and 5).

With respect to the polymer B too, the distance of the inlets 76 on the plate 8 and all of the delivery sections or channels 74, 75 to the die, is held constant by the arrangement which has been already described with reference to FIG. 3 (i.e. circle arch paths 711 to 715 of FIG. 5).

With the plates 6 and 8 being combined in the distributing pack 1 of FIG. 1, the above described channels 7 and 9 will be mutually arranged according to FIG. 1. From such an illustration it should be apparent the characteristic bilateral arrangement of the channels 74 and 75 for distributing the polymer B with respect to the related channel 92 for distributing the polymer A. Such a bilateral distribution will provide the channel arrangement for distributing the mentioned polymeric materials with a radial orientation with respect to the disclosed distributing pack, of the type channel 75 (polymer B)—channel 92 (polymer A)—channel 74 (polymer B).

Figure 6:
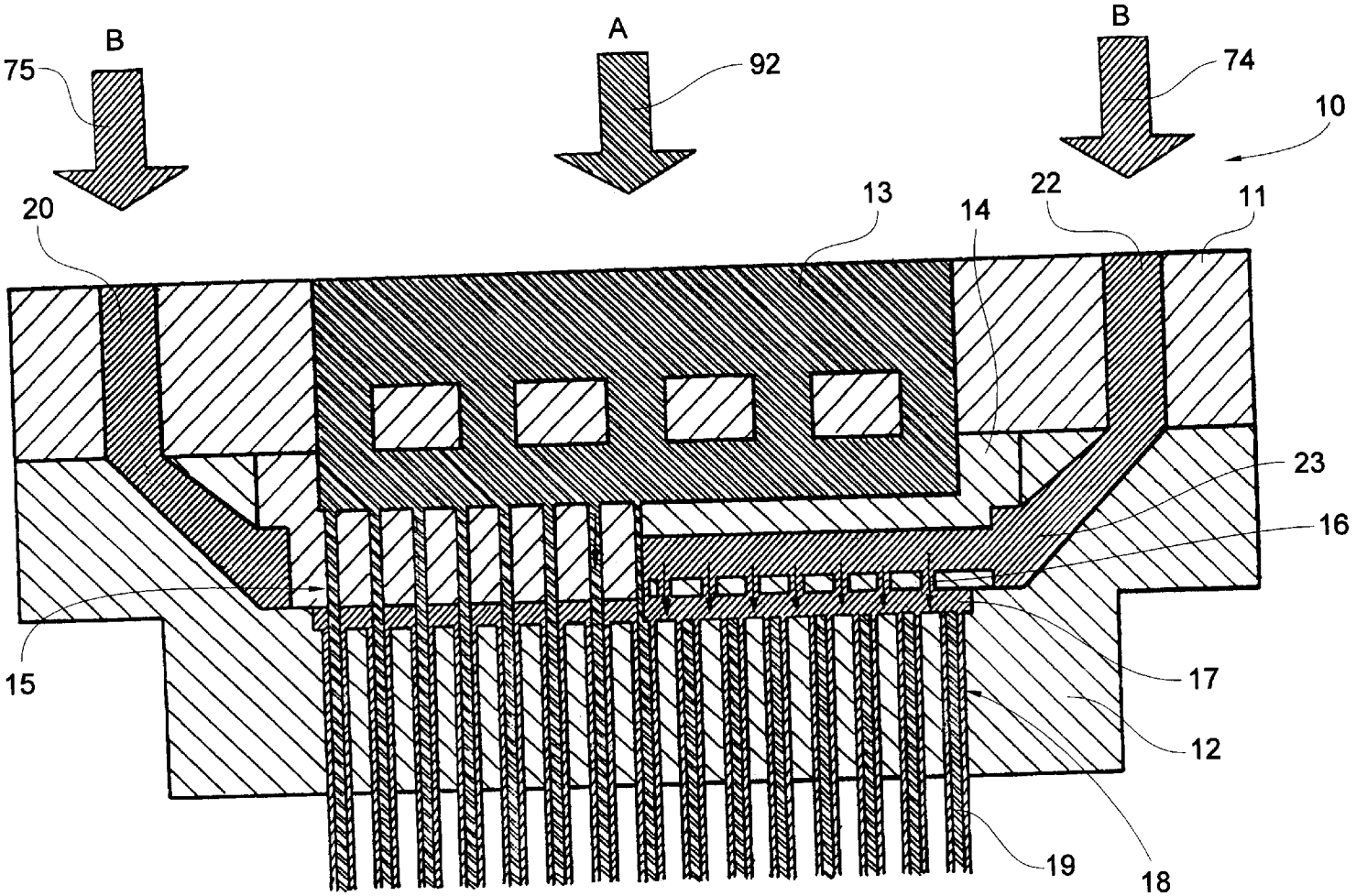
FIG. 6 is a cross-sectional view illustrating the detail 1A of the apparatus shown in FIG. 1.
Figure 7:
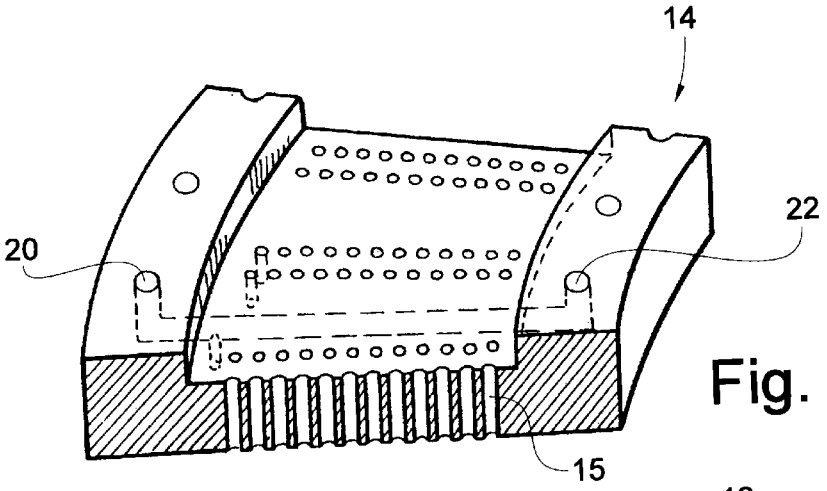
FIG. 7 is a perspective view illustrating a portion of the die shown in FIG. 6, as cross-sectioned through the line of the polymer A transfer holes.
Figure 9:
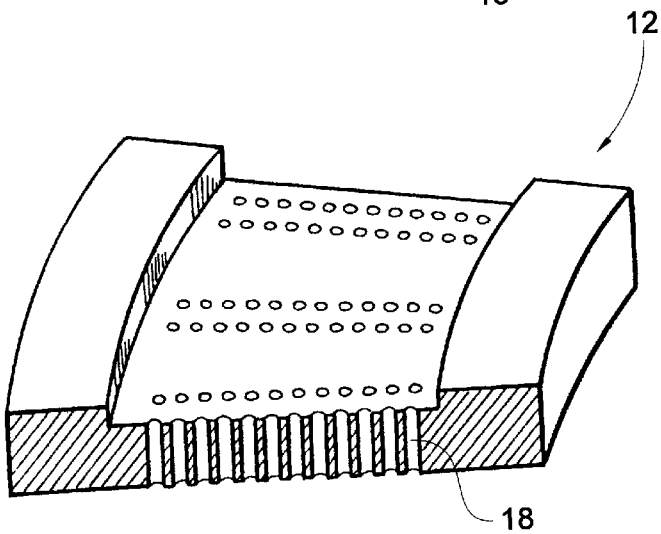
FIG. 9 is a perspective view illustrating a portion of the extruding die of FIG. 6, as cross-sectioned along the line of the extruding holes.

The polymers A and B, at the outlet from said distributing pack through the respective channels 74, 75 for the polymer B and 92 for the polymer A, will arrive at the spinning assembly 10 shown in FIG. 6. This assembly is provided with a top plate 11, having a shape like the above disclosed one, provided with a central annular chamber 13 for collecting the polymer A supplied through the channel 92. The same plate 11 is moreover provided with a plurality of side holes or channels 20 and 22 respectively arranged on the inner side and outer side of said central chamber 13 for collecting the polymer B being respectively supplied through the channels 75 and 74.

Underlaying the plate 11 is provided a further plate 14, of like shape, which is adapted to operate as a pre-spinning element or pre-die. This plate, in particular, is provided with a plurality of vertically extending holes 15, which define the channel for sending the polymer A, by itself, from the mentioned chamber 13 toward the die 12. Owing to the alternated arrangement of the rows of the holes 15, the pre-die 14 will be provided with corresponding rows of holes 16, which are radially aligned with respect to the preceding holes, and allowing the polymer B to be sent, by itself, to the die 12 (arrows of FIG. 6). The holes 16 communicate moreover with cross channels 23 which receive the polymer B, as bilaterally supplied with respect to the polymer A, through the channels 20 and 22 (FIG. 6).

Under the hereinabove disclosed plate 14, is provided the die proper, which is constituted by a plate 12 in turn provided with a plurality of holes 18 arranged in the same direction of the holes 15 and 16 of the pre-die 14. In the embodiment being illustrated, each hole 18 is coaxially arranged with respect to the corresponding holes 15 of the pre-die 14.

From FIG. 6 it should be moreover apparent that the die 12 is provided, at the ring like or annular surface engaging with the overlaying plate 14 and immediately above the holes 18, with a chamber 17. This chamber 17 will communicate, from the top, with the holes 15 and 16 of the pre-die 14 and, toward the bottom, with the holes 18 of the die 12. Moreover, since the axes of the mentioned holes 15, 16 and 18 are mutually parallel, the chamber 17 will transfer, in a co-current manner, the masses of the polymers A and B toward the die 12 (see the arrows of FIG. 6). Those same holes 15, 16, 18 can moreover have a cross section of any desired shape (either circular, square, rectangular or the like) having an area preferably from 0.03 to 3.50 $mm^2$.

The extruding method performed by the above disclosed apparatus according to the present invention will be disclosed in a more detailed manner hereinafter.

Through the lines 21 and 31, the extruders 2 and 3 will supply the polymer A and B molten masses toward the corresponding channels 9 and 7 of the apparatus 1. More specifically, the polymer A is supplied to the spinning assembly 10 through the channels or vertical holes 92 of the plate 8, whereas the polymer B will arrive at that same assembly 10 through vertical channels or holes 74 and 75 of the plate 6, with a bilateral distribution with respect to that of the polymer A.

Thus, the polymers A and B will arrive, respectively, at the central chamber 13 and side channels 20, 22 of the plate 11 of the spinning assembly 10. From this region onward, the polymer A will flow inside the holes 15 of the pre-die 14, in a coaxial direction with respect to the direction of the holes 18 of the die 12.

The polymer B, which is supplied laterally with respect to the polymer A (and, accordingly, also laterally of the die 12) will be brought above the latter, so as to be distributed inside the mentioned cross channels 23. The latter, in addition to supplying the polymer B mass from the side edges of the spinning assembly 10 toward the die 12, will operate as "plenum chambers" allowing the mentioned polymeric mass to be properly re-arranged above the die. Thus, the discontinuities of the chemical-physical parameters (temperature, pressure, speed, viscosity and so on) of the molten mass of the polymer B and which are caused by the direction change to which said mass is subjected in passing from the side channels 20, 22 to the cross channels 23, are nullified or zeroed, thereby providing an optimum constant value of these parameters, at any points inside the mass to be extruded.

Figure 8:
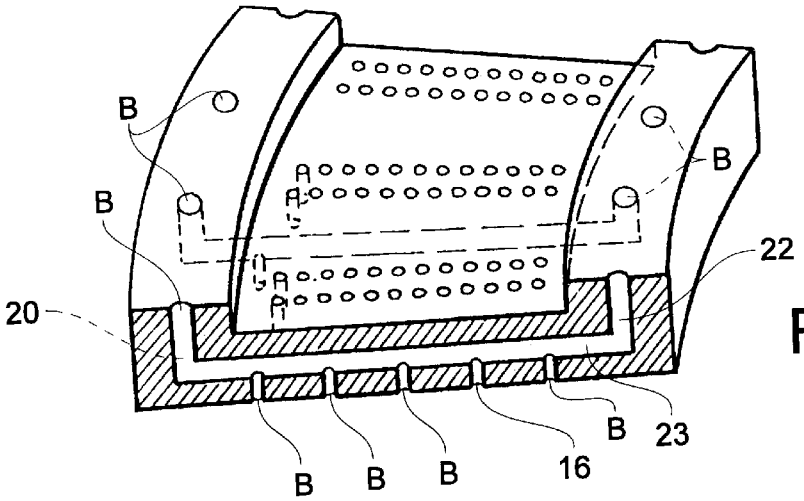
FIG. 8 illustrates the pre-die of FIG. 7, with a cross-section taken along the line of the polymer B transfer holes.
Figure 11:
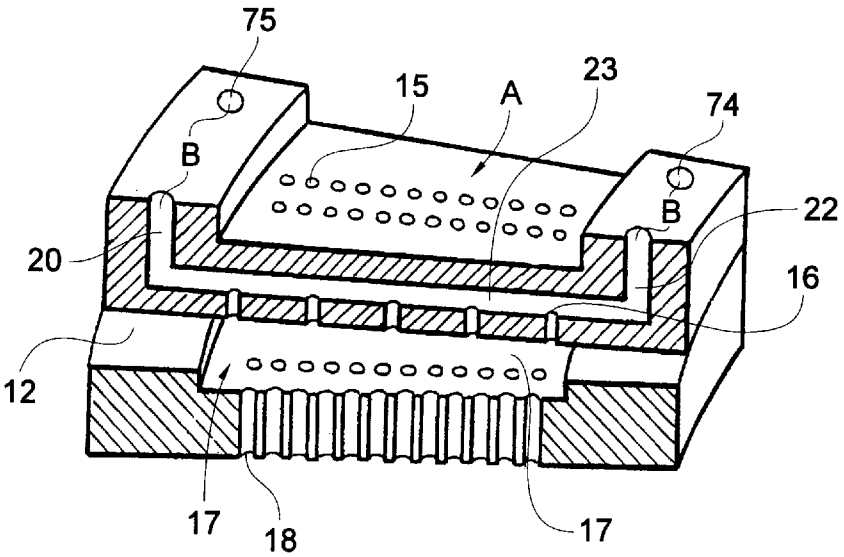
FIG. 11 illustrates the apparatus obtained by assembling the apparatus portions shown in FIGS. 8 and 9.

The polymer B mass, the parameters of which have been so adjusted in order to properly supply it to the die 12, is then oriented according to the flow streams created by the passage of said mass through the holes 16 of the pre-die 14. Thus, the polymer B which was transversely directed inside the channel 23, with respect to the extruding direction, is now caused to flow with a co-current arrangement with respect to the polymer A. Thus, the chamber 17 arranged immediately upstream of the die 12 will be always supplied by:

- a stream of the polymer A flowing, through the holes 15 of the pre-die 14, in the same direction as that of the axis of the holes 18 of the die 12, and
- a stream or current of polymer B flowing, through the holes 16 of said pre-die 14, in the same direction or in a co-current manner with respect to the polymer A flow (see the arrows in FIG. 8) and, accordingly, parallel to the longitudinal axis of the holes 18 of the die 12.

At the inlet of the holes 18 of the extruding die 12, accordingly, will arrive the two streams of polymers A and B which were previously supplied together inside the chamber 17, in the above disclosed manner.

According to a modified embodiment shown in FIGS. 7 to 11, the pre-die 14, which is made as a single piece with the plate 11 of the apparatus of FIG. 6, is also provided with a plurality of holes or channels 23, each of which has a cross section which substantially corresponds to the sum of the areas of the holes 16 opening on said channel. Owing to the disclosed sizing of the holes 16 and respectively the holes 23, the polymer B (supplied to the latter holes through the hole assembly respectively indicated by 75, 20 and 74, 22) will find, inside said channels 23, a sufficient space or volume to allow the desired levelling of the pressures, before entering the chamber 17. Also in this modified embodiment, moreover, the holes 16 of each hole row radially arranged on the bottom of the pre-die 14, have diameters which can be changed depending on the melt or fluidity condition of the polymer B, thereby optimally distributing the latter in the chamber 17. Such a variation will depend, of course, on the unidirectional or bidirectional supplying of the channels 23.

Figure 10:
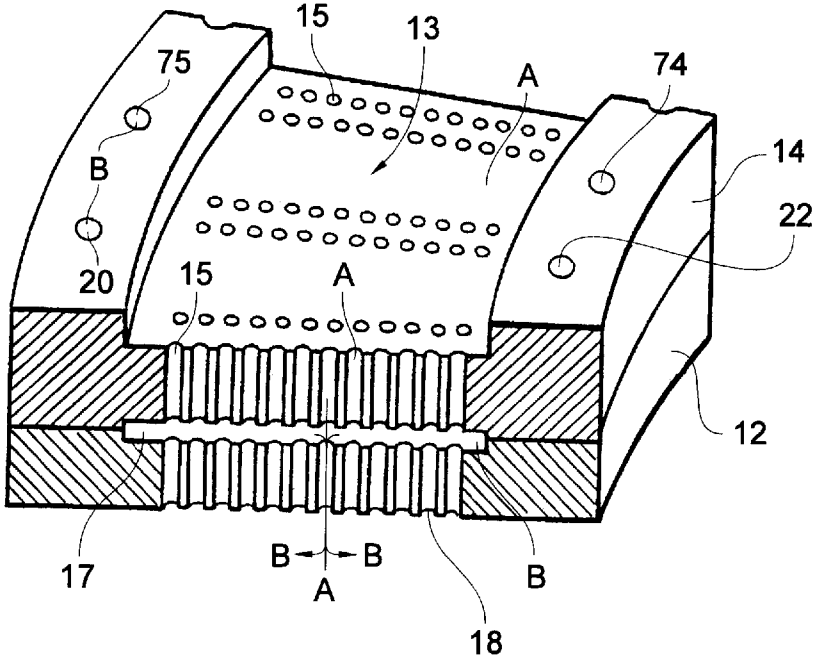
FIG. 10 illustrates the apparatus made by assembling the apparatus portions shown in FIGS. 7 and 9.

In the preferred embodiment shown in the mentioned figures, the number of the holes 16 corresponds to about 20% of the number of the holes 18 of the extruding die 12, and they do not have any relationship with the position or distribution of the latter. More specifically, according to a preferred embodiment of the invention, on a pre-die 14—die 12 assembly as shown in FIG. 10 having a diameter of 500 mm, are provided 25,000 holes 15 and respectively 18, with a diameter which can vary from 0.10 to 2.5 mm.

Owing to the adoption of the size ratios which has been above disclosed, it was possible to obtain, on a system of the type "short-spin" (that is of the short-spinning type) two-component fibers having a count greater than 0.75 denier, with a very good production yield.

In particular, the variation coefficient (CV%) of the count of the fibers was less than 10. Accordingly, a high size eveness of the fibers was obtained which confirms the great advantages provided by the present invention.

In this connection it should be pointed out that the arrangement or distribution of the holes 15, 18 with respect to the holes or channels 23 can be provided in double radial rows (embodiment shown in FIGS. 7 to 11, in which the number of the holes 23 is one half of the number of the radial rows along which are distributed the holes 15), or also according to either individual or multiple rows (i.e. the number of the rows of holes 15 and 18 can be either decreased or increased with respect to that shown in the mentioned examples).

In this modified embodiment too, the polymers or copolymers which can be used will be of commercially available types.

Thus, according to the invention, the stream or current of the polymer B supplied in a cross direction above the extruding die 12 (i.e. in a direction which is different from the extruding direction) will be at first adjusted, so as to provide constant values of the parameters thereof through the overall mass thereof. Then, the polymer B will be re-addressed so as to change from a cross supplying direction to a co-current supplying direction, parallel to the extruding direction.

To achieve a very good result on the control of the parameters of the polymers being supplied to the extruding die 12, will also contribute the configuration of the polymer distributing channels 9 and 7, for respectively distributing the polymers A and B. Such an arrangement, actually, has been designed so as to provide the polymer paths to the spinning die 10 with the same lengths, independently from the position of the corresponding delivery section 74, 75 and 92 on the distributing pack 6, 8. Thus, it will be possible to precisely and accurately control the parameters related to these components as the yarn is formed, which will accordingly have the desired count as well as the set compositions of the materials A and B, in a like manner for all of the fibers which are extruded.

The embodiment of the spinning assembly 10 shown in FIG. 6 is of a type suitable to provide the so-called "sheath-core" yarns, in which the polymer B will completely coat a central core formed by the polymer A. In this connection it should be apparent that, by means of an offset arrangement of the holes 15 with respect to the holes 18 (not shown), it will be also possible to make yarns having a so-called "side-by-side" construction, or any other desired texture.

It should be moreover pointed out that further modifications and variations can be brought to the above disclosed and illustrated apparatus, which can be related to the shape of the distributing back plates (either a quadrangular or any other shape) and with respect to the arrangement of the channels for distributing the polymers or materials to be extruded. Within the scope of the invention, the inventive apparatus can also be modified so as to include therein a single side channel (20 or 22) for supplying the polymer B to the extruding die. The cross sections of the channels 23, moreover, can also be different from the shown cross-section (i.e. outwardly tapering from the extruding die or from the center towards the edge portions of the extruding die, respectively in the case of an unidirectional or bidirectional supplying). Moreover, the holes 16 of the pre-die 14 can also be oriented differently from the above disclosed orientation and, advantageously, they could also have a diameter increasing from the supply point of the component B toward the inside of the channels 23: actually, the advantages of the invention would be exclusively derived from the provision of the channels 23 for redistributing the polymer being supplied laterally of the extruding die.

Finally, the above disclosed and illustrated apparatus can be used in different types of spinning systems, in particular in the "long-spinning", "short-spinning", "spun-bonding" and "melt-blown" spinning systems.

I claim:

1. An apparatus for making fibers consisting of first and second polymer components, said apparatus comprising:

(a) an extruding die formed with a plurality of holes for extruding said polymer components, said holes being formed to extend linearly through said extruding die in spaced parallel relation to one another:

(b) a pre-die plate for collecting and adjusting the flow of said first and second polymer components and directing them in a direction generally toward said holes in said extruding die, said pre-die plate including (i) a first plurality of pre-die holes which are formed in said pre-die plate to extend linearly through said pre-die plate in spaced parallel relation to one another and in a direction parallel to said linear extent of said extruding die holes for directing the flow of said first polymer component;

(ii) a channel formed in said pre-die plate for directing the flow of said second polymer component, said channel including a portion thereof extending in angular relation to said linear extent of said first plurality of pre-die holes such that the flow of said second polymer component will be mixed and homogenized in said channel; and (iii) a second plurality of pre-die holes which are formed in said pre-die plate to extend linearly from said channel in spaced parallel relation to one another and in a direction parallel to said first plurality of pre-die holes and to said extruding die holes for redirecting the flow of said second component from the direction caused by said channel to a direction parallel to said direction of flow of said first polymer component through said first plurality of pre-die holes, and (c) a distribution system comprising a top plate including a first portion of a distribution channel for distributing said second polymer component, and a second plate in which is formed a channel for distributing said first polymer component and a second distributing portion for distributing said second polymer component, with either a unidirectional or bilateral orientation with respect to said channel for distributing said first polymer component.

2. An apparatus according to claim 1, wherein said holes of said pre-die plate are aligned on said pre-die plate.

3. An apparatus according to claim 2, wherein said holes are arranged in alternating rows on said pre-die plate.

4. An apparatus according to claim 1, further comprising a chamber, defined between said pre-die plate and said extruding die to receive co-current flows of said first and second polymer components coming from said pre-die plate so as to transfer said co-current flows to said extruding die.

5. An apparatus according to claim 1, wherein said channels for distributing said first and second polymer components have equal lengths, from an inlet of said first and second polymer components, to outlets of said first and second polymer components.

6. An apparatus according to claim 5, wherein said channels comprise a plurality of channel segments which are symmetrically linked with one another.

7. An apparatus according to claim 6, wherein said channels comprise a plurality of channel segments provided in said distribution system, of which one supplies a polymer mass to a plurality of paths provided, with end outlet sections for discharging said polymer mass.

8. An apparatus according to claim 1, wherein said first portion extends with two horizontal arms oriented on a horizontal plane of said plate.

9. An apparatus according to claim 8, wherein said arms end with perpendicular arm channels extending through said distribution system.

10. An apparatus according to claim 1, for making synthetic sheath-core fibers, wherein said pre-die plate holes are coaxial to said holes of said extruding die.

11. An apparatus according to claim 1, for making synthetic side-by-side fibers, wherein said pre-die plate holes are offset from said holes of said extruding die.

12. An apparatus according to claim 1, wherein said pre-die plate holes have increasing diameters which increase from a supplying point of said second polymer component toward said channels.

13. An apparatus for making fibers consisting of first and second polymer components, said apparatus comprising:

(a) an extruding die formed with a plurality of holes for extruding said polymer components, said holes being formed to extend linearly through said extruding die in spaced parallel relation to one another:

(b) a pre-die plate for collecting and adjusting the flow of said first and second polymer components and directing them generally toward said holes in said extruding die, said pre-die plate including (i) a first plurality of pre-die holes which are formed in said pre-die plate to extend linearly through said pre-die plate in spaced parallel relation to one another and in a direction parallel to said linear extent of said extruding die holes for directing the flow of said first polymer component;

(ii) a channel formed in said pre-die plate for directing the flow of said second polymer component; and (iii) a second plurality of pre-die holes which are formed in said pre-die plate in communication with said channel for directing the flow of said second component; and (c) a distribution plate located upstream of said pre-die plate and being formed with a plurality of supply openings for supplying all of at least one of said components to said pre-die plate, and two distribution channels each having an inlet and a network of channels for supplying said at least one component to said plurality of supply openings, one said distribution channel being in communication a first portion of said supply openings and the other of said distribution channel being in communication with the remainder of said supply openings, and said two distribution channels each being arranged within said distribution plate to provide an equal distance of travel for said at least one component between said inlet thereof and each of said supply openings thereof, respectively.

* * * * *